United States Patent [19]

Kwak

[11] Patent Number: 4,826,341

[45] Date of Patent: May 2, 1989

[54] VALVE MEANS FOR TOOTHBRUSH CONTAINING TOOTHPASTE DISPENSER THEREIN

[76] Inventor: Kyu Ho Kwak, 2811 Shanandale Dr., Silver Spring, Md. 20904

[21] Appl. No.: 101,976

[22] Filed: Sep. 28, 1987

[51] Int. Cl.[4] ..... A46B 11/02

[52] U.S. Cl. ..... 401/280; 401/84; 401/155; 401/158; 401/161; 401/169; 401/286

[58] Field of Search ..... 401/278, 279, 280, 281, 401/152, 155, 156, 158, 161, 84, 169, 288, 286; 132/84 B

[56] References Cited

U.S. PATENT DOCUMENTS

| | | | |
|---|---|---|---|
| 818,000 | 4/1906 | Stevenson | 401/155 |
| 1,386,806 | 8/1921 | Schmerler | 132/84 B |
| 1,769,206 | 7/1930 | Coady | 401/288 |
| 2,607,513 | 8/1952 | Lawson | 401/280 X |
| 2,638,614 | 5/1953 | Anderson | 401/280 |
| 3,383,157 | 5/1968 | Goldhirsh | 401/280 X |
| 3,712,747 | 1/1973 | Drohomirecky | 401/155 |
| 4,036,412 | 7/1977 | Craig | 401/155 X |
| 4,116,570 | 9/1978 | Parenti | 401/155 |

FOREIGN PATENT DOCUMENTS

| | | | |
|---|---|---|---|
| 2310846 | 9/1974 | Fed. Rep. of Germany | 401/155 |
| 74823 | 8/1958 | France | 401/84 |
| 717419 | 10/1954 | United Kingdom | 401/169 |

*Primary Examiner*—Steven A. Bratlie

*Attorney, Agent, or Firm*—Birch, Stewart, Kolasch & Birch

[57] ABSTRACT

A toothbrush device which comprises a body member having a main chamber disposed therein and a handle slidably disposed thereon, the chamber contains a toothpaste dispenser disposed therein whereby toothpaste disposed in the toothpaste dispenser is dispensed from the toothpaste dispenser by pressing the handle against the toothpaste dispenser after operating an on switch. Thereafter, by operating an off switch, the toothpaste dispenser is closed.

4 Claims, 3 Drawing Sheets

VALVE MEANS FOR TOOTHBRUSH CONTAINING TOOTHPASTE DISPENSER THEREIN

CROSS REFERENCE TO RELATED APPLICATION

This application is related to application Ser. No. 043,357 filed Apr. 28, 1987 pending.

BACKGROUND OF THE INVENTION

1. Field of the Invention

The present invention relates to a device for a toothbrush containing a toothpaste dispenser therein. More particularly, the present invention relates to an improved toothbrush device enclosing a flexible toothpaste dispenser within the handle whereby when cleaning the teeth, the toothpaste is caused to flow from the toothpaste dispenser to the plurality of bristles of the toothbrush member by pressing the handle against the dispenser.

2. Description of the Prior Art

There are many types of toothbrush devices which are well known in the prior art which utilize a toothpaste dispenser therein. However, the toothpaste flows continuous from a toothpaste dispenser to a plurality of bristles through an opening whereby it is good for only a single brushing. Thus, none of the known conventional toothbrush devices provide a toothbrush member containing a flexible toothpaste dispenser disposed therein which is provided with an on/off switch so that the toothpaste dispenser can be used a multiplicity of times and readily reloaded by merely changing the toothpaste dispenser.

OBJECTS AND SUMMARY OF THE INVENTION

Accordingly, it is an object of the present invention to provide a toothbrush device containing a toothpaste dispenser disposed therein.

Another object of the present invention is to provide an improved device for a toothbrush which enclosing a toothpaste dispenser, which is easily replaceable.

A further object of the present invention is to provide a device for a toothbrush which is structured with an on/off switch associated therewith whereby when the toothbrush device is operated by engaging the on switch, the toothpaste is caused to immediately flow a plurality of bristles of a toothbrush member by pressing a handle provided on the device. Thereafter the toothpaste dispenser can be closed by operating off portion of the switch.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

Briefly described, the present invention relates to a toothbrush device which comprises a body member having a main chamber disposed therein and a handle slidably disposed thereon, the chamber contains a toothpaste dispenser disposed therein whereby toothpaste disposed in the toothpaste dispenser is dispensed from the toothpaste dispenser by pressing the handle against the toothpaste dispenser after operating an on switch. Thereafter, by operating an off switch, the toothpaste dispenser is closed.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 1:
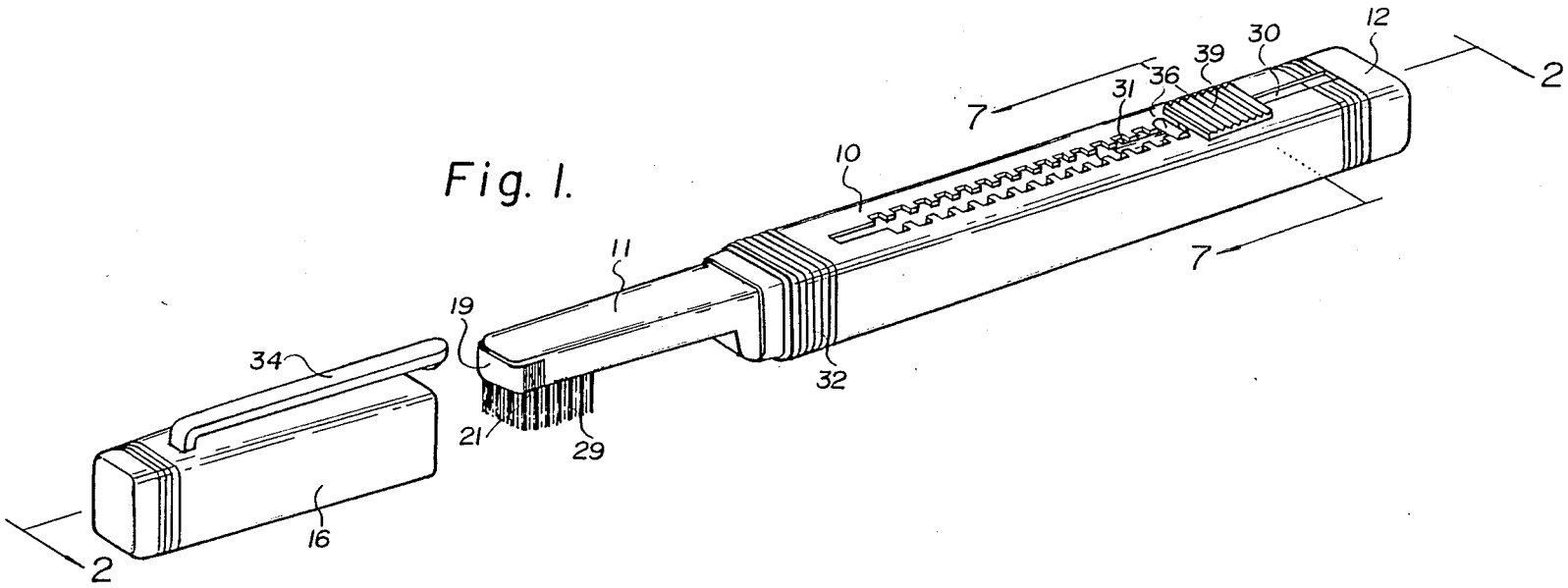
FIG. 1 is a perspective view of the toothbrush assembly of the present invention.
Figure 2:
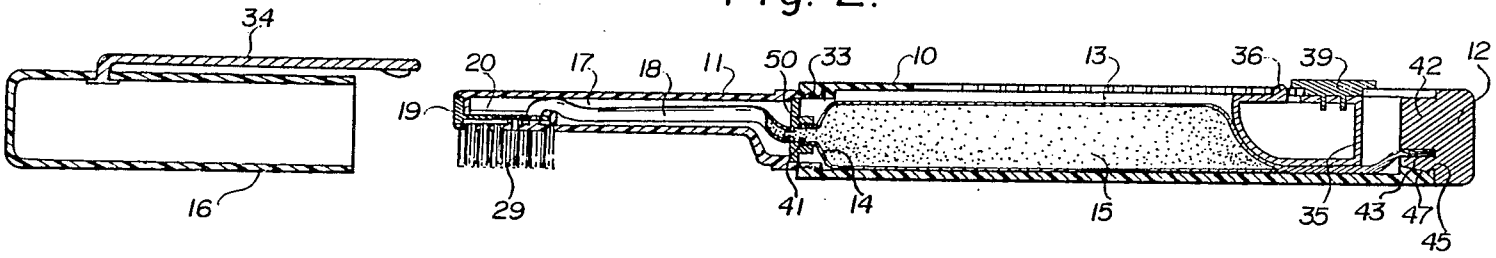
FIG. 2 is a cross-sectional view of FIG. 1, taken along line 2—2.
Figure 3:
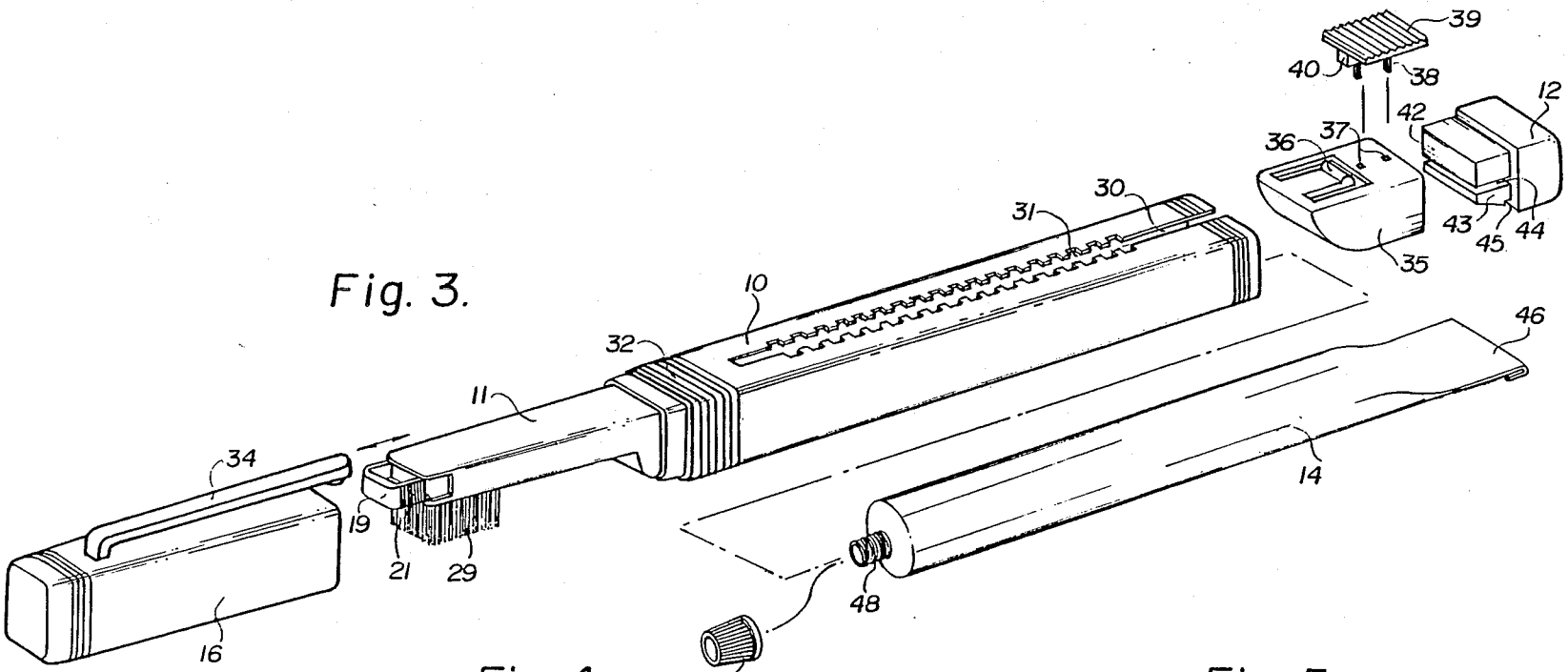
FIG. 3 is an exploded view of the toothbrush assembly of the present invention.

Referring now in detail to the drawings for the purpose of illustrating the present invention, the toothbrush device containing a toothpaste dispenser disposed therein as shown in FIGS. 1, 2, and 3 comprises a body member 10, a toothbrush member 11 disposed at one end of the body member 10 and a removal cap member 12 disposed at the other end thereof. The body member 10 is provided with a main chamber 13 for housing a toothpaste dispenser 14 containing toothpaste 15 therein. Also, the toothbrush member 11 is provided with a removal toothbrush cap 16 having a clip 34 for covering the toothbrush member 11 through screw members 32 and 33 and for hanging it on a pocket. The toothpaste dispenser 14 for the toothpaste 15 disposed therein is made of a flexible material such as a rubber or a plastic.

Figure 4:
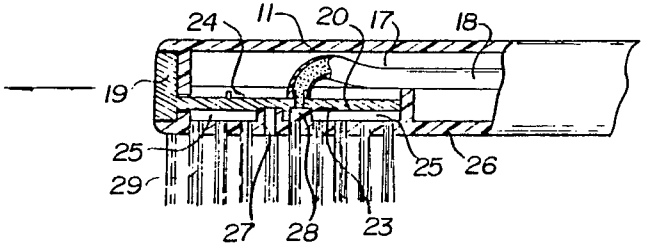
FIG. 4 is a side view of the toothbrush member of the present invention containing cutaway portions in order to illustrate the off switch position of the device of the present invention.
Figure 5:
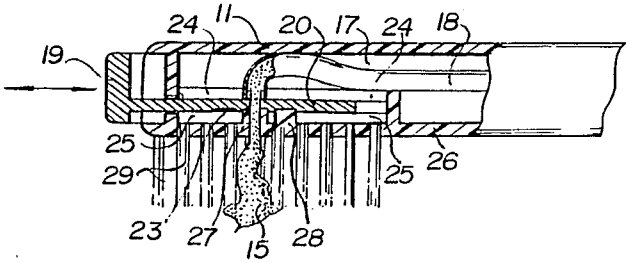
FIG. 5 is a side view of the toothbrush member showing the on switch position of the device.
Figure 7:
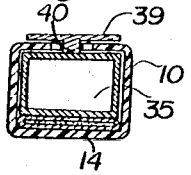
FIG. 7 is a cross-sectional view of FIG. 1, taken along line 7—7.
Figure 6:
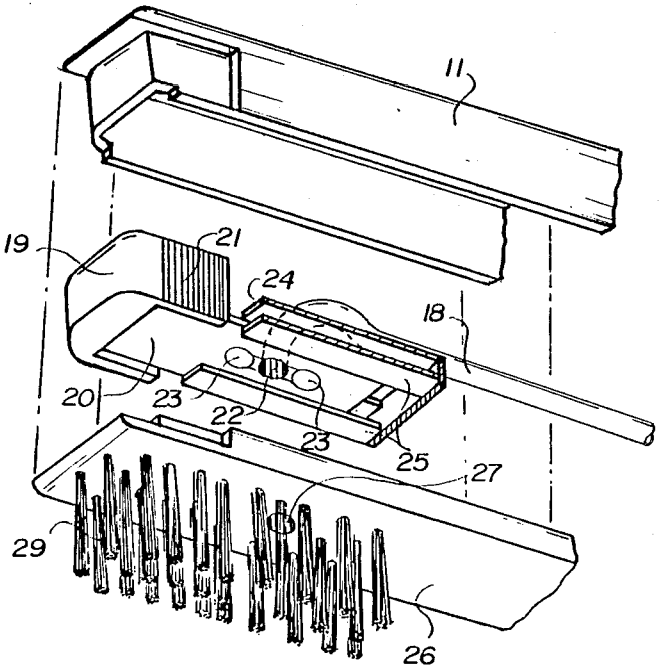
FIG. 6 is a perspective view of the on/off switch for the toothpaste dispenser of the present invention.

As shown in FIGS. 4, 5, 6, the toothbrush member 11 is provided with a toothbrush chamber 17 containing a toothpaste conduit 18 which connects to an opening 48 of the toothpaste dispenser 14 whereby the toothpaste 15 from the toothpaste dispenser 14 is disposed through an aperture 27 disposed in the toothbrush wall 26 to a plurality of bristles 29. The toothbrush wall 26 contains a raised portion 28 disposed on the right side of the aperture 27. The aperture 27 has a circumferential raised portion 51 thereof.

The on/off switch 19 has a pair of lateral threaded portions 21 disposed at both sides thereof for use as a handle and also contains a sliding plate 20. The sliding plate 20 includes a pair of grooves 23 disposed on the inside surface thereof and an aperture 22 disposed between the pair of grooves 23 for operatively aligning with the aperture 27 of the toothbrush wall 26. One end of the toothpaste conduit 18 connects with the aperture 27 on the wall 26 of the toothbrush member 11 through the aperture 22 of the sliding plate 20. The toothbrush conduit 18 is made of a flexible materials such as a rubber, a plastic, or the like for easily moving from the aperture 27 to the raised portion 28.

Figure 8:
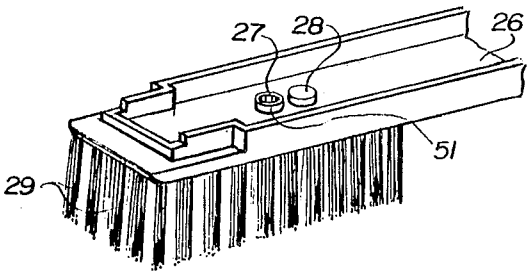
FIG. 8 is a perspective view of the toothbrush wall portion of the present invention.

As shown in FIGS. 6 and 8, the sliding plate 20 operatively slides between a pair of intermediate supporting plates 24 and a pair of bottom supporting plates 25. When the aperture 22 of the sliding plate 20 coincides with the aperture 27 of the toothbrush wall 26, the on/off switch 19 is in the "on" position, and the toothpaste is dispensed by pressing the toothpaste dispenser 14 with a handle member 39 (FIG. 5). Thus the toothpaste 15 is caused to flow from the toothpaste dispenser 14 to the plurality of bristles 29 of the toothbrush member 11 through the toothpaste conduit 18. At this time, the circumferentially raised portion 51 of the aperture 27 of the toothbrush wall 26 tightly connects to the aperture 22 of the sliding plate 20 and the raised portion 28 of the toothbrush wall 26 slidably engage the pair of grooves 23 of the sliding plate 20. When the user pushes the "off" portion of the on/off switch 19, the aperture 22 of the sliding plate 20 is moved onto the raised portion 28 disposed on the right side of the aperture 27 of the toothbrush wall 26 and the groove 23 disposed at the left side of the aperture 22 tightly closes the aperture 27 of the toothbrush wall 26 to prevent the toothpaste 15 from leaking from a connecting area between the sliding plate 20 and toothbrush wall 26 (FIG. 4).

The removal toothbrush cap 16 disposed at the end of the toothbrush member 11 can be attached thereto or detached therefrom for preventing the toothbrush from becoming contaminated (FIGS. 1 and 3). As shown in FIGS. 2 and 3, the dispenser 14 has the opening 48 disposed at one end thereof to engage a hole 41 located on a portion 50 disposed between the main toothbrush chamber 13 and toothbrush chamber 17. Also, the dispenser 14 is provided with a rear flat portion 46 which enables a pressing member 35 attached to a handle member 39 to be applied against the rear portion of the dispenser 14. The handle member 39 is connected to the pressing member 35 by connecting members 38 which are attached to a support 40 thereof and are inserted into apertures 37 of the pressing member 35. The handle member 39 is moved between parallel teeth lines 31 disposed at the top of the body member 10. Thus, the toothpaste 15 can be dispersed from the dispenser 14 by pushing the handle member 39 along a space 30 disposed between the parallel teeth lines 31 at the top of the body member 10. The handle member 39 can be locked in position in teeth by a biased locking member 36 which is connected to the pressing member 35 for engaging slots defined by a pair of opposing teeth.

The body member 10 contains a hollow portion disposed therein for receiving a supporting plate 42 and a tapered tensible plate 43. A space 44 disposed between plates 42 and 43 is adapted to receive the rear flat portion 46 of the toothpaste dispenser 14. At this time, an engaging member 47 disposed at the rear end edge of the body member 10 engages in a slot 45 disposed at the rear portion of the tapered plate 43 (FIG. 2).

In operation, after removing the removable cap member 12 from the device of the present invention, the toothpaste dispenser 14 containing the toothpaste 15, is placed in the main chamber 13 in the body member 10. After attaching the handle member 39, including the pressing member 35 and the removal cap member 12 to the main body member 10, the toothpaste 15 is dispensed by pressing the handle member 39 which squeezes the dispenser 14 causing the toothpaste 15 to flow from the dispenser 14 to the plurality of bristles 29 through the toothbrush conduit 18. At this time, the switch is in the "on" position. Since the toothpaste dispenser 14 is secured to the body member 10, by the opening 48 secured on the hole 41 and the rear flat portion 46 is engaged in the space 44 disposed between the plates 42 and 43 of the removal cap member 12, the toothpaste dispenser 14 does not move during the squeezing of the dispenser 14 by the handle members 39. Furthermore, the rear flat portion 46 is tightly engaged in the space 44 causing the tapered plate 43 to close to the supporting plate 42 because the plates 42 and 43 are tightly engaged into the hollow in the pressing member 35.

The invention being thus described, it will be obvious that the same may be varied in many ways. Such variations are not to be regarded as a departure from the spirit and scope of the invention, and all such modifications as would be obvious to one skilled in the art are intended to be included in the scope of the following claims.

What is claimed is

1. A toothbrush device containing a toothpaste dispenser therein which comprises:

a body member containing a main chamber and provided with a teeth configurated slot along one surface and a toothbrush member extending from the opposite surface thereof, a toothpaste dispenser disposed in said main chamber, said toothpaste dispenser containing an opening at one end thereof, said toothbrush member being disposed at one end of said body member and containing toothbrush bristles, a toothbrush wall, and a toothbrush chamber, a flexible toothpaste conduit disposed in said toothbrush chamber for providing a fixed communication between said toothpaste dispenser in said main chamber and said toothbrush bristles, a removal cap disposed at the other end of said body member, on/off switch means including a sliding plate slidably extending into the end portion of said toothbrush chamber, said sliding plate having an aperture, said aperture being disposed between a pair of grooves, connected to said flexible toothpaste conduit, said toothbrush wall containing a raised aperture and an adjacent raised stud member whereby, when the switch means is in the "on" position, the aperture in the sliding plate is in alignment with the raised aperture in the toothbrush wall for distributing toothpaste to the toothbrush bristles and the raised stud member is engaged in one of said grooves, and when said switch means is in the "off" position, the raised aperture in the toothbrush wall is engaged in the other of said grooves in the sliding plate and the raised stud member in the toothbrush wall tightly closes the aperture in the sliding plate so that the on/off switch means prevents the toothpaste from leaking from the zone between the sliding plate and the toothbrush wall and slidably locks the sliding plate in the toothbrush wall, and handle means having a biased locking member slidably disposed along said teeth configurated slot, said handle means being locked in position by said biased locking member, said handle means extending into said main chamber, whereby the toothpaste is effectively dispersed from the toothpaste dispenser through the main chamber by pressing the handle means against the toothpaste dispenser.

2. The toothbrush device of claim 1 wherein the toothpaste dispenser includes a rear flat portion for engaging in a space disposed between a supporting plate and a tensible supporting plate of the removal cap.

3. The toothbrush device of claim 2 wherein the tensible supporting plate is a tapered configuration for tightly engaging in a hollow of the body member.

4. The toothbrush device of claim 1 wherein the toothpaste dispenser is made of a flexible material.

* * * * *